United States Patent [19]

Benn et al.

[11] Patent Number: 4,832,734

[45] Date of Patent: May 23, 1989

[54] HOT WORKING ALUMINUM-BASE ALLOYS

[75] Inventors: Raymond C. Benn; Prakash K. Mirchandani; Walter E. Mattson, all of Huntington, W. Va.

[73] Assignee: Inco Alloys International, Inc., Huntington, W. Va.

[21] Appl. No.: 190,714

[22] Filed: May 6, 1988

[51] Int. Cl.[4] ..... C22C 21/00

[52] U.S. Cl. ..... 75/249; 148/126.1; 75/256; 419/17; 419/32; 419/48; 419/50

[58] Field of Search ..... 419/32, 17, 48, 50; 75/256, 249; 148/126.1

[56] References Cited

U.S. PATENT DOCUMENTS

| | | | |
|---|---|---|---|
| 3,740,210 | 6/1973 | Bomford et al. | 75/0.5 AC |
| 3,874,938 | 4/1975 | Benjamin et al. | 75/246 |
| 4,292,079 | 9/1987 | Pickens et al. | 419/11 |
| 4,297,136 | 10/1987 | Pickens et al. | 419/11 |
| 4,600,556 | 7/1986 | Donachie et al. | 148/12.7 A |
| 4,624,705 | 11/1986 | Jatkar et al. | 419/11 |
| 4,668,470 | 5/1987 | Gilman et al. | 419/32 |
| 4,688,282 | 5/1987 | Gilman et al. | 75/0.5 R |
| 4,722,751 | 2/1988 | Akechi et al. | 75/244 |

OTHER PUBLICATIONS

W.A.L. Tech. Report AFML-TR 79-4210.

Quarterly Report No. 01 900°F. Al Maters. Research Air Force Cont. No. F 33615-86-C-6074, Oct. 1986, pages cover, Legend II.

*Primary Examiner*—Stephen J. Lechert, Jr.

*Attorney, Agent, or Firm*—Raymond J. Kenny; Francis J. Mulligan, Jr.

[57] ABSTRACT

Discloses hot working by rolling or forging of mechanically alloyed aluminum-base alloys containing 5 to 35 volume percent of an aluminum transition metal intermetallic phase, e.g. $Al_3Ti$ which is insoluble in the solid aluminum matrix. Hot working is carried out at a temperature above about 370° C.

6 Claims, No Drawings

HOT WORKING ALUMINUM-BASE ALLOYS

The present invention is concerned with hot working of aluminum-base alloys and, more particularly, with hot working by forging, rolling and the like aluminum-base alloys having an ultra-fine hard dispersed transition-metal-intermetallic phase in the microstructure, this intermetallic dispersed phase being of such a character that it cannot be solubilized in the aluminum matrix below the melting point of the matrix.

BACKGROUND OF THE INVENTION

It is known to produce dispersion hardened aluminum-base alloys by powder metallurgical methods and, more particularly, to use the process known as mechanical alloying in the production of such alloys. Generally, a mechanically alloyed (or otherwise formed) aluminum powder containing a dispersoid is hot compressed in a vacuum and consolidated and formed by extrusion. A problem exists in producing useful shapes from the dispersion hardened aluminum bar stock provided by extrusion when the bar stock contains significant amounts of dispersed, transition metal, intermetallic phase insoluble in the solid aluminum matrix.

Ordinarily a cheap, generally applicable metallurgical solution to providing useful shapes from extruded or otherwise formed bar stock is hot working by forging, rolling or the like. In such processes, unlike extrusion, metal is free to expand in more than one direction. Generally speaking, such forging, rolling and the like is done hot because at high temperatures metal is weaker and has good ductility. At high temperatures precipitated strengthening phases dissolve; matrices change from one phase to another, e.g. ferrite to austenite; and generally workability as indicated by tensile elongation is enhanced. An exception exists in the case of mechanically alloyed dispersion-hardened aluminum containing insoluble intermetallic dispersoid. It has been observed in mechanically alloyed aluminum-base alloys containing $Al_3Ti$ dispersant that, as the test temperature rises, while the strength of dispersion-hardened aluminum alloys decreases, the ductility as measured by elongation in tensile testing, also decreases.

The ductility of two- (or multi-) phase alloys is most commonly discussed in the art in terms of the volume fraction of the hard phases. Previous theoretical as well as experimental studies have demonstrated that at a given temperature, particularly at room temperature, alloy ductility (as evidenced by the elongation to fracture during a tensile test) decreases sharply as the volume fraction of the hard phase increases. From previous empirical work, a simple relationship has been developed relating ductility and hard-phase volume fraction:

$$\text{Elongation to fracture} = k \cdot \frac{(1-f)}{f}$$

In this equation k is an empirical constant (whose value depends upon the characteristics of the matrix alloy), and f is the volume fraction of the hard phase. The above relationship has been shown to hold approximately true at room temperature for a variety of dual or multi-phase alloys, including Al-SiC composites.

DISCOVERY

Applicants have discovered that in aluminum alloys made by mechanical alloying and containing dispersed hard phase made of an aluminum-transition metal intermetallic compound (e.g., $Al_3Ti$) which is essentially insoluble below the solidus of the aluminum matrix, the tensile elongation at all temperatures is in excess of what would previously have been expected in mechanical alloyed aluminum alloys at least over the range of about 5 to 35 advantageously 15 to 30 volume percent of intermetallic phase. Even more unexpectedly, applicants have discovered that at temperatures in excess of about 370° C., e.g. about 427° C. and higher, but below the solidus temperature of the matrix, alloys prepared by mechanical alloying and containing 5–35 volume percent $Al_3Ti$ in an aluminum matrix along with dispersed $Al_4C_3$ and $Al_2O_3$ have tensile elongations in excess of 5% and are therefor amenable to hot working.

In contrast, work done by applicants' former colleagues on mechanically alloyed aluminum-base alloys containing titanium and reported to Wright Aeronautical Laboratories as published Technical Report AFML-TR-79-4210 showed tensile elongation decreasing with temperature to 2.5% and 1–3% at 343° C. for alloys containing 4.13 and 10 volume percent $Al_3Ti$ dispersant respectively. Based upon the knowledge of mechanically alloyed aluminum alloy systems available at that time, the occurrence of anomalously high ductility at temperatures higher than 343° C. was completely unknown to those of normal skill in the art.

Moreover, applicants have discovered that the present worked alloys retain good strength, ductility and stable microstructure.

OBJECT OF THE INVENTION

It is the object of the invention to provide a hot working process for a dispersion-hardened aluminum alloy made by mechanical alloying wherein the hard phase is present in an amount of about 5 to 35 volume percent and comprises an aluminum transition metal intermetallic compound, advantageously including a transition metal from the group of titanium, vanadium, zirconium, niobium, iron, cobalt, nickel, tantalum, manganese, chromium and hafnium, essentially insoluble in the aluminous matrix at temperatures below the solidus temperature of the matrix. This object also includes the hot worked alloy product.

DESCRIPTION OF THE INVENTION

The present invention contemplates hot working by a process permitting metal flow in at least two directions, a mechanically alloyed aluminum-base alloy consisting essentially of an aluminum matrix containing optional solid solution hardeners, about 5 to about 35 volume percent of an aluminum transition metal intermetallic compound, carbide phases, principally aluminum carbide up to about 14 volume percent and optional oxidic phases, principally aluminum oxide up to about 5 volume percent, said hot working being conducted in the temperature interval between 370° C. and the solidus temperature of the aluminum matrix. The invention also contemplates the resultant hot worked alloy which exhibits a unique combination of strength, modulus, ductility and stability over a range of temperatures up to about 95% of the melting temperature (0.95 Tm).

The aluminum-base alloys to be hot worked in accordance with the present invention are made by mechanical alloying following generally procedures as described in U.S. Pat. Nos. 3,740,210, 4,668,470 and 4,688,282 using stearic acid as a process control agent.

The levels of carbide and oxide set forth in the preceding paragraph generally derive from the levels of process control agent normally used in mechanical alloying with or without intentional inclusion of oxide, e.g. alumina or yttria or carbon in a mechanically alloyed charge. For example, up to about 5 volume percent carbide and 2 volume percent oxide are the usual amounts of these phases encountered when stearic acid is employed as the process control agent with no other non-metallic additions to the charge. Those skilled in the art will appreciate that, although levels above 5 volume percent carbide and 2 volume percent oxide can be present in hot worked alloys of the invention, one can expect decreased alloy ductility at such high levels. Compositions of hot worked aluminum-base alloys are set forth in Table 1.

TABLE 1

COMPOSITIONS OF MA Al—Ti BASED ALLOYS

| Alloy No. | Composition (Wt. %) | | | | |
|---|---|---|---|---|---|
| | Al | Ti | C | O | Other |
| 1 | Bal. | 6.0 | 2.20 | 0.75 | — |
| 2 | Bal. | 8.7 | 2.60 | 0.85 | — |
| 3 | Bal. | 9.7 | 1.50 | 0.60 | — |
| 4 | Bal. | 9.8 | 1.50 | 0.51 | 1.9 Mn |
| 5 | Bal. | 9.7 | 1.55 | 0.61 | 1.8 Cr |
| 6 | Bal. | 9.8 | 1.56 | 0.62 | 2.2 V |
| 7 | Bal. | 10.0 | 1.54 | 0.66 | 1.76 Ni |
| 8 | Bal. | 10.1 | 1.51 | 0.61 | 1.88 Co |
| 9 | Bal. | 9.7 | 1.58 | 0.55 | 2.10 Nb |
| 10 | Bal. | 9.9 | 1.53 | 0.55 | 1.97 Mo |
| 11 | Bal. | 12.3 | 1.50 | 0.85 | — |

Those skilled in the art will appreciate that the percent by weight compositions set forth in Table 1 can be converted to approximate percent by volume of phases such as $Al_2O_3$, $Al_4C_3$, $Al_3Ti$ and the like by simple formulas such as:

$$\text{Wt. \% O} \times 1.7 = \text{Vol. \% } Al_2O_3$$

$$\text{Wt. \% C} \times 3.71 = \text{Vol. \% } Al_4C_3$$

$$\text{Wt. \% Ti} \times 2.5 = \text{Vol. \% } Al_3Ti$$

The alloys in Table 1 contain roughly 15 to 31 volume percent of aluminum transition metal intermetallic phase, specifically in alloys 1–3 and 11 the phase being $Al_3Ti$ in the range of 15 to 31 volume percent. In alloys 4 to 10 the intermetallic phase is a combination made up principally of $Al_3Ti$ along with aluminides and/or other compounds of other transition metals. Those skilled in the art will appreciate that the "intermetallic phase" may be a single phase or more than one phase, no specific limitation being implied by the singularity of the term "intermetallic phase". After mechanical alloying, alloys 1–11 were consolidated and extruded at about 400° C. using an extrusion ratio of about 15 to 1. Tensile characteristics of the as-extruded alloys are set forth in Table 2.

TABLE 2

MECHANICAL PROPERTIES OF MA Al—Ti BASED ALLOYS[1]

| Alloy No. | T | UTS | YS | $e_f$ | E |
|---|---|---|---|---|---|
| 1 | 24 | 467.6 | 379.4 | 14.0 | 88.9 |
| | 427 | N.A. | N.A. | N.A. | |
| 2 | 24 | 471.1 | 375.9 | 12.0 | 98.0 |
| | 427 | N.A. | N.A. | N.A. | |
| 3 | 24 | 487.2 | 464.8 | 7.1 | 96.6 |
| | 427 | 112.0 | 100.8 | 8.3 | |

TABLE 2-continued

MECHANICAL PROPERTIES OF MA Al—Ti BASED ALLOYS[1]

| Alloy No. | T | UTS | YS | $e_f$ | E |
|---|---|---|---|---|---|
| 4 | 24 | 573.3 | 520.8 | 5.4 | 103.6 |
| | 427 | 109.2 | 99.4 | 12.4 | |
| 5 | 24 | 490.0 | 410.2 | 5.4 | 101.5 |
| | 427 | 123.2 | 109.2 | 11.6 | |
| 6 | 24 | 590.8 | 532.7 | 3.6 | 103.6 |
| | 427 | 132.3 | 123.9 | 8.9 | |
| 7 | 24 | 725.9 | 706.3 | 1.8 | 103.4 |
| | 427 | N.A. | N.A. | N.A. | |
| 8 | 24 | 478.1 | 426.3 | 8.9 | 102.9 |
| | 427 | 122.7 | 105.7 | 10.1 | |
| 9 | 24 | 530.6 | 478.1 | 8.9 | 100.1 |
| | 427 | N.A. | N.A. | N.A. | |
| 10 | 24 | 530.8 | 469.0 | 5.4 | 100.8 |
| | 427 | 125.3 | 119.0 | 9.2 | |
| 11 | 24 | 441.3 | 372.3 | 10.0 | 100.0 |
| | 427 | N.A. | N.A. | N.A. | |

[1]T = Test temperature (°C.)
UTS = Ultimate tensile strength (MPa)
YS = 0.2% Yield strength (MPa)
$e_f$ = Elongation to fracture (%)
E = Elastic modulus (GPa)
N.A. = Not available All of the alloys set forth in Table 1 were successfully hot rolled in the temperature range of about 400° C. to about 510° C. from 50×100 mm thick bar to sheet about 1.5 mm thick and about 90 to 100 mm wide.

In sheet form, these alloys retained excellent combinations of strength, ductility and modulus indicative of stable microstructures as shown by the data given in Table 3.

TABLE 3

TENSILE PROPERTIES OF MA Al—Ti ALLOYS IN SHEET FORM[1]

| Alloy No. | T | UTS | YS | $e_f$ | E |
|---|---|---|---|---|---|
| 3 | 24 | 441 | 413 | 11.0 | 93.1 |
| | 150 | 343 | 308 | 6.2 | — |
| | 315 | 196 | 167 | 4.3 | — |
| | 427 | 112 | 102 | 12.1 | — |
| 11 | 24 | 465 | 430 | 9.0 | 100.0 |
| | 150 | 350 | 321 | 4.9 | — |
| | 315 | 202 | 179 | 3.2 | — |
| | 427 | 120 | 109 | 10.3 | — |

[1]T = Test temperature (°C.)
UTS = Ultimate tensile strength (MPa)
YS = 0.2% Yield strength (MPa)
$e_f$ = Elongation to fracture (%)
E = Elastic modulus (GPa)

For purposes of this specification and claims the term "solid solution hardeners" in an aluminum matrix includes not only normal elements such as silicon, copper, lithium, magnesium and zinc which, in conventional amounts, are soluble in a solid aluminum matrix but also those elements which, although forming insoluble products at low temperature, e.g. below 100° C. are soluble in the matrix at the temperature of hot working. Also for purposes of this specification and claims the term "carbide phases" includes not only aluminum carbide but also titanium carbide, carbides of other alloy ingredients and chemical modifications of aluminum, titanium and other carbides. The term "oxidic phase" is intended to include not only aluminum oxide formed by reaction between aluminum and oxygen in the stearic acid process control agent during mechanical alloying but also small amounts, e.g. up to about 5 volume percent of other oxide, e.g. yttria, yttrium-aluminum-garnet or alumina which might be added to or formed while processing a mechanical alloying charge.

While in accordance with the provisions of the statute, there is described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. Hot working, by a process permitting metal flow in at least two directions, of a consolidated mechanically alloyed aluminum-base alloy consisting essentially of a matrix of aluminum containing optional solid solution hardeners, about 5–35% by volume of an aluminum transition metal intermetallic phase containing at least one metal of the group consisting of manganese, chromium, vanadium, iron, nickel, cobalt, niobium, tantalum and titanium essentially insoluble in the matrix below the solidus temperature of the matrix, optional carbide phases consisting principally of aluminum carbide in an amount up to about 14 volume percent and up to about 5 volume percent of oxidic phase, said hot working being conducted in the temperature interval between 370° C. and the solidus temperature of the aluminum matrix.

2. Hot working as in claim 1 wherein said aluminum transition metal intermetallic phase in the alloy being worked is principally $Al_3Ti$ in an amount of at least about 15 volume percent.

3. Hot working as in claim 2 wherein said aluminum transition metal intermetallic phase contains at least one metal from the group of manganese, chromium, vanadium, nickel, cobalt, niobium and molybdenum.

4. Hot working as in claim 2 carried out in the temperature range of 400° C. to 510° C.

5. Hot working as in claim 4 by rolling.

6. A hot worked object produced by the process of claim 1.

* * * * *